US007062200B2

(12) United States Patent
Ueno et al.

(10) Patent No.: US 7,062,200 B2
(45) Date of Patent: Jun. 13, 2006

(54) PROCESS CARTRIDGE AND ELECTROPHOTOGRAPHIC IMAGE FORMING APPARATUS

(75) Inventors: Takahito Ueno, Shizuoka (JP); Atsushi Numagami, Kanagawa (JP); Masaki Kakitani, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/949,198

(22) Filed: Sep. 27, 2004

(65) Prior Publication Data

US 2006/0045565 A1 Mar. 2, 2006

(30) Foreign Application Priority Data

Aug. 26, 2004 (JP) ..... 2004-246616

(51) Int. Cl.
*G03G 21/16* (2006.01)

(52) U.S. Cl. ..... 399/111; 399/109

(58) Field of Classification Search ..... 399/109, 399/111, 113, 119, 120
See application file for complete search history.

(56) References Cited

U.S. PATENT DOCUMENTS 6,236,821 B1 5/2001 Yokoyama et al. ..... 399/113
6,684,040 B1 * 1/2004 Yokoi et al. ..... 399/119
6,782,213 B1 * 8/2004 Watanabe et al. ..... 399/12
6,829,455 B1 * 12/2004 Yasumoto et al. ..... 399/167

FOREIGN PATENT DOCUMENTS

JP 11-15354 A 1/1999
JP 2004-30773 A 1/2004

* cited by examiner

*Primary Examiner*—Hoang Ngo
(74) *Attorney, Agent, or Firm*—Fitzpatrick, Cella, Harper & Scinto

(57) ABSTRACT

A process cartridge having an insertion construction for a connecting pin swingably supporting a developing unit where there are achieved an improvement in assembly property, a minimization of container deformation, and prevention of coming-off of the connecting pin due to a small press-fitting region. The connecting pin swingably supporting the developing unit is formed of a styrene-based resin composite, and, by injecting a terpene solvent from a cutout of a photosensitive drum unit frame to the outer periphery of the connecting pin, integral connection is effected between the photosensitive drum unit frame and the connecting pin, and further, between the photosensitive drum unit frame and a drum bearing member. Due to a press-fit portion between the connecting pin and the photosensitive drum unit frame, no terpene solvent flows to the developing unit side.

16 Claims, 10 Drawing Sheets

PROCESS CARTRIDGE AND ELECTROPHOTOGRAPHIC IMAGE FORMING APPARATUS

This application claims priority from Japanese Patent Application No. 2004-246616 filed on Aug. 26, 2004, which is hereby incorporated by reference herein.

BACKGROUND OF THE INVENTION

1. Field of the Invention

The present invention relates to a process cartridge for use in a copying machine, a printer, etc. adopting an electrophotographic process, and to an electrophotographic image forming apparatus using the same.

2. Related Background Art

Here, an electrophotographic image forming apparatus is an apparatus that forms an image on a recording medium by using an electrophotographic image forming system. Examples of an electrophotographic image forming apparatus include an electrophotographic copying machine, an electrophotographic printer (laser beam printer, LED printer, and the like), a facsimile machine, and a word processor.

A process cartridge is obtained by integrating charging means, developing means, or cleaning means with an electrophotographic photosensitive drum into a cartridge which is detachably mountable to an image forming apparatus main body. Apart from this, a process cartridge is obtained by integrating at least one of charging means, developing means, and cleaning means with an electrophotographic photosensitive drum into a cartridge which is detachably mountable to an image forming apparatus main body. Further, a process cartridge is obtained by integrating at least developing means with an electrophotographic photosensitive drum (hereinafter referred to as the photosensitive drum) into a cartridge which is detachably mountable to an electrophotographic image forming apparatus main body.

Conventionally, an image forming apparatus using the electrophotographic image forming process adopts a process cartridge system, in which an electrophotographic photosensitive member and process means acting thereon are integrated into a cartridge, which is detachably mountable to the image forming apparatus main body. In such a process cartridge system, the user can perform maintenance on the apparatus without relying on the serviceman, so that it is possible to achieve a substantial improvement in terms of operability. Thus, the process cartridge system is widely used for image forming apparatuses.

As shown in FIG. 2, such a process cartridge is composed of a photosensitive drum unit 50 having a photosensitive drum 1, a charging device 2, and a cleaning device, and a developing unit 4 having developing means for developing an electrostatic latent image on the photosensitive drum 1, with their respective frames being connected together by connecting pins. As shown in FIG. 2, in a process cartridge 7, the component units are connected together by mating connecting holes 47 (48) provided at both ends of the developing unit frame 46 with support holes provided at both ends of the photosensitive drum unit frame 51 of the photosensitive drum unit 50 and by inserting pins from both ends of the photosensitive drum unit 50.

In effecting connection on the conventional process cartridge, metal pins are brought into press-fit-engagement with the photosensitive drum unit frame so as to involve no play, and the developing unit frame is slidably supported in the region between the press-fit engagement portions.

In addition to quality, production efficiency is required of the recent image forming apparatuses. To achieve this, it is indispensable to achieve an improvement in the assembly property of the process cartridge through simplification of the assembly, a reduction in the number of inspection steps, etc., which proves particularly effective for the process cartridge, which is a consumable article. From this viewpoint, in simplifying the components of the process cartridge and reducing the number of inspection steps, it is necessary to satisfy the requirement in terms of quality after the completion of the product and to perform a design which helps to minimize deformation after assembly and variation in assembly.

SUMMARY OF THE INVENTION

The present invention has been made with a view toward solving the above problem in the conventional art.

It is an object of the present invention to achieve an improvement in terms of assembly property.

Another object of the present invention is to prevent frame deformation.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

In the following, a multicolor image forming apparatus according to an embodiment of the present invention will be described in more detail with reference to the drawings.

[General Construction of the Multicolor Image Forming Apparatus]

Figure 1:
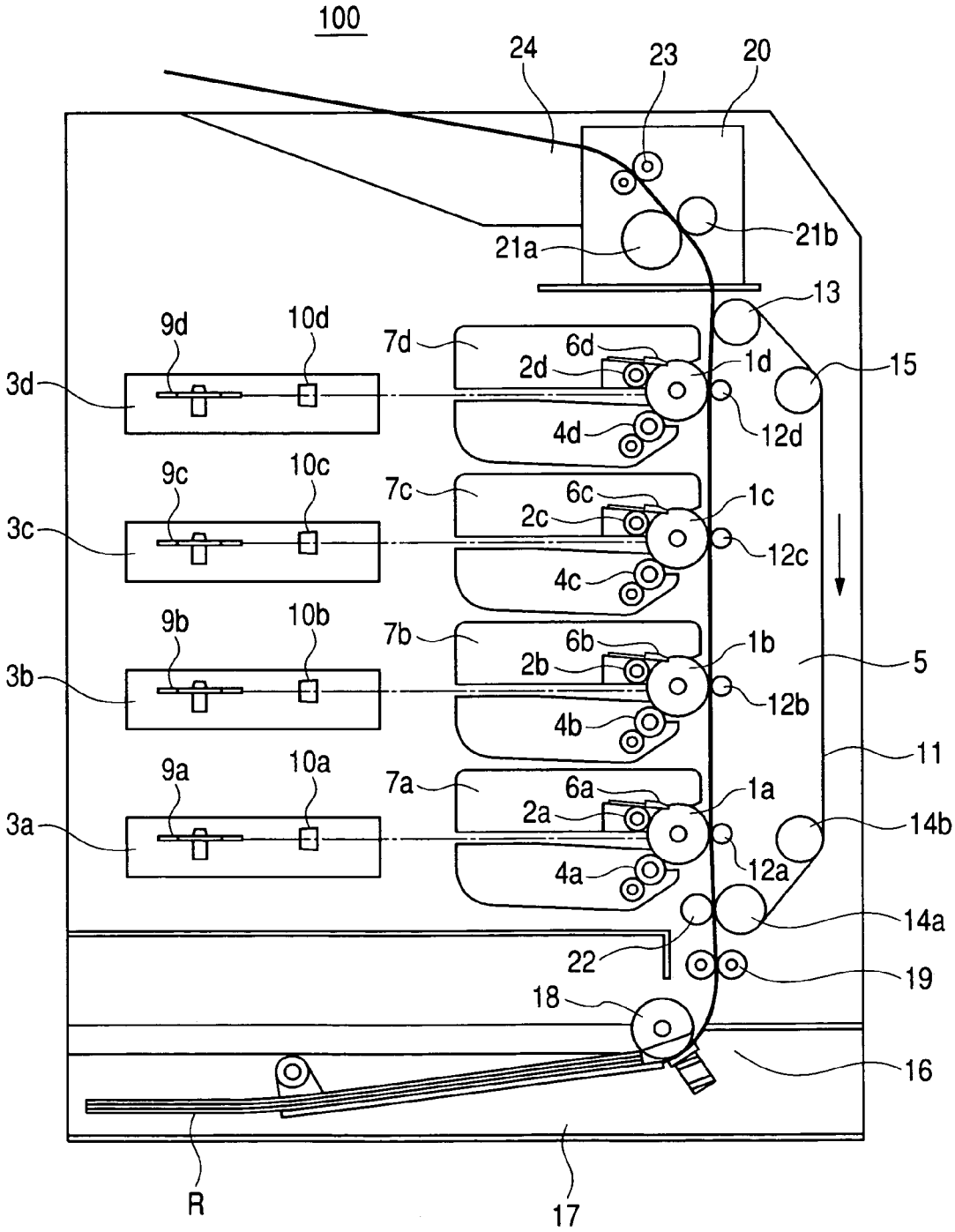
FIG. 1 is a sectional view of an example of a multicolor image forming apparatus according to the present invention.

First, the general construction of the multicolor image forming apparatus will be schematically described with reference to FIG. 1. FIG. 1 is a longitudinal sectional view showing the general construction of a full-color laser beam printer 100, which is a form of a multicolor image forming apparatus.

The multicolor image forming apparatus 100 shown in FIG. 1 is equipped with four electrophotographic photosensitive drums 1 (1*a*, 1*b*, 1*c*, and 1*d*), which are arranged side by side in the vertical direction. The photosensitive drums 1 are rotated counterclockwise as shown in FIG. 1 by driving means (not shown). Around the photosensitive drums 1, there are sequentially arranged, in the rotating direction, charging devices 2 (2*a*, 2*b*, 2*c*, and 2*d*) for uniformly charging the surfaces of the photosensitive drums 1, scanner units 3 (3*a*, 3*b*, 3*c*, and 3*d*) for applying laser beams based on image information to form electrostatic latent images on the photosensitive drums 1, developing devices 4 (4*a*, 4*b*, 4*c*, and 4*d*) for causing toners to adhere to the electrostatic latent images to develop them into toner images, an electrostatic transfer device 5 for transferring the toner images on the photosensitive drums 1 to a transfer material R, cleaning devices 6 (6*a*, 6*b*, 6*c*, and 6*d*) for removing transfer residual toner from the surfaces of the photosensitive drums 1 after transfer, etc. Here, the photosensitive drums 1, the charging devices 2, the developing devices 4, and the cleaning devices 6 are integrated into process cartridges 7 (7*a*, 7*b*, 7*c*, and 7*d*). In the following, the above components will be sequentially described, starting from the photosensitive drums 1.

Each photosensitive drum 1 is formed by providing a photoconductive layer on the outer peripheral surface of an aluminum cylinder with a diameter, for example, of 24 mm. Each photosensitive drum 1 is rotatably supported at both ends by support members; by transmitting driving force from a drive motor (not shown) to one end, it is rotated counterclockwise.

As the charging devices 2, it is possible to use contact charging type ones. Each charging member is formed as a conductive roller, which is brought into contact with the surface of the photosensitive drum 1, and a charging bias voltage is applied to this roller, thereby uniformly charging the surface of the photosensitive drum 1. This embodiment adopts a reversal developing system, so that the surfaces of the photosensitive drums 1 are charged to a negative polarity.

The scanner units 3 apply, by laser diodes (not shown), image light corresponding to image signals to polygon mirrors 9 (9*a*, 9*b*, 9*c*, and 9*d*), which are rotated at high speed by scanner motors (not shown). The image light reflected by the polygon mirrors 9 is used to selectively perform exposure on the surfaces of the photosensitive drums 1 that have undergone charging to thereby form electrostatic latent images.

Figure 2:
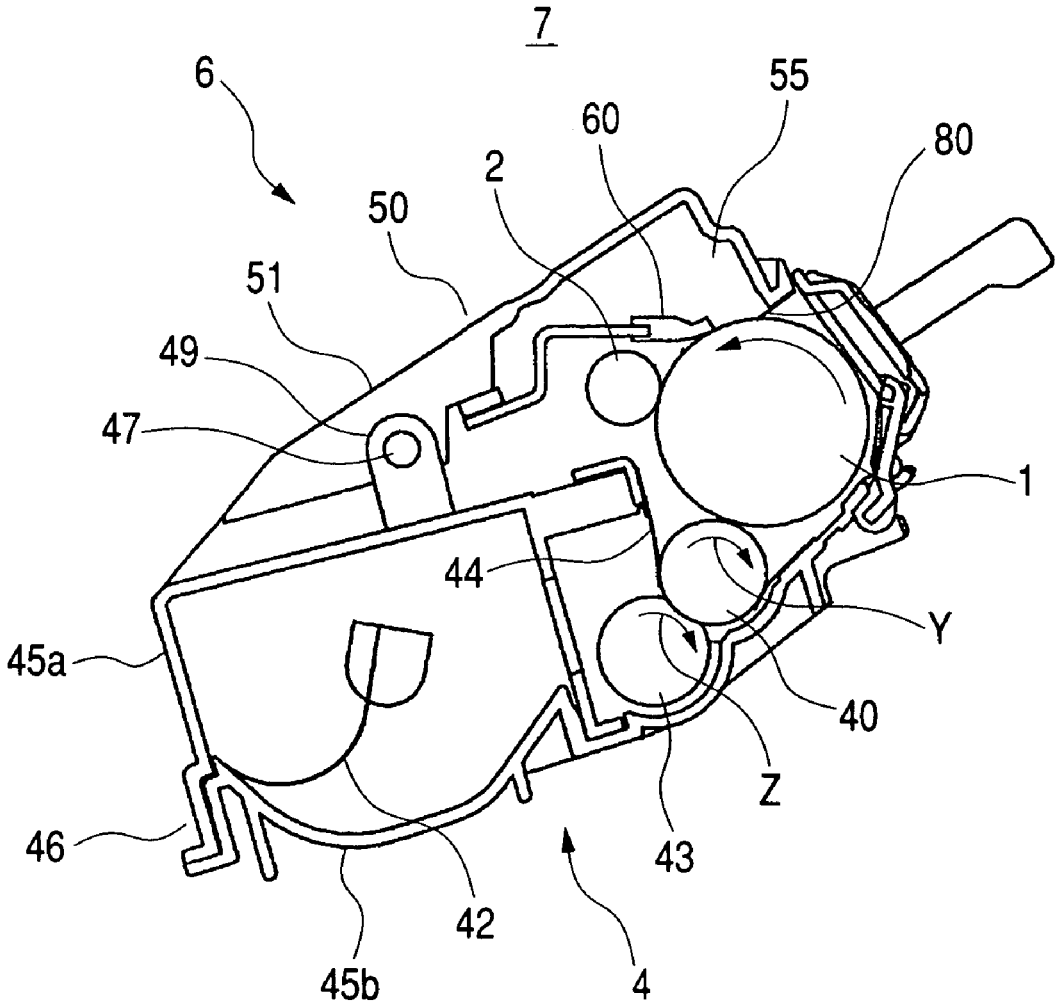
FIG. 2 is a sectional view of a process cartridge according to the present invention.

Referring to FIG. 2, the developing devices 4 will be described. The developing devices 4 are formed by toner containers respectively containing yellow, magenta, cyan, and black toners; in each of them, the toner in the developing unit frame 46 is fed to a toner supply roller 43 by a feeding mechanism 42. The toner supply roller 43 rotates clockwise as shown in FIG. 2, supplying toner to a developing sleeve 40, which serves as a developer carrier, and scraping away toner from the developing sleeve 40 after development on the photosensitive drum 1.

The toner supplied to the developing sleeve 40 is applied to the outer periphery of the developing sleeve 40, which rotates clockwise as shown in FIG. 2, by means of a developing blade 44 held in press contact with the outer periphery of the developing sleeve 40, and, at the same time, receives charge.

Then, by applying a developing bias to the developing sleeve 40 opposed to the photosensitive drum 1 with a latent image formed thereon, development with toner is performed on the photosensitive drum 1 in accordance with the latent image.

The electrostatic transfer device 5 is equipped with an electrostatic conveyor belt 11 opposed to all the photosensitive drums 1*a*, 1*b*, 1*c*, and 1*d* and adapted to run while in contact therewith. The electrostatic conveyor belt 11 consists, for example, of a resin film or a multi-layer film-like member formed by providing a resin layer on a rubber base layer. The electrostatic conveyor belt 11 is stretched between a driving roller 13, driven rollers 14*a* and 14*b*, and a tension roller 15; it holds the transfer material R on the left-hand outer peripheral surface as shown in FIG. 1 by an electrostatic attracting force, and runs so as to bring the transfer material R into contact with the photosensitive drums 1. In this way, the transfer material R is conveyed to transfer positions by the electrostatic conveyor belt 11, and the toner images on the photosensitive drums are transferred to the transfer material R.

Transfer rollers 12 (12*a*, 12*b*, 12*c*, and 12*d*) are arranged side by side so as to be in contact with the inner side of the electrostatic conveyor belt 11 and at positions opposed to the four photosensitive drums 1*a*, 1*b*, 1*c*, and 1*d*. At the time of transfer, a bias of positive polarity is applied to the transfer rollers 12, and a charge of positive polarity is applied to the transfer material R through the electrostatic conveyor belt 11. Due to an electric field generated in this process, the toner image 6*f* negative polarity on each photosensitive drum 1 is transferred to the transfer material R held in contact with the photosensitive drum 1.

A sheet feeding portion 16 serves to feed and convey the transfer materials R to the image forming portions, and has a sheet feeding cassette 17 containing the plural transfer materials R. When performing image formation, a feeding roller 18 (semicircular roller) and registration rollers 19 are rotated in accordance with the image forming operation, feeding one by one the transfer materials R in the sheet feeding cassette 17; in this process, the leading end of each transfer material R abuts the registration rollers 19 to stop temporarily and forms a loop before being fed to the electrostatic conveyor belt 11 by the registration rollers 19 in synchronism with the running of the electrostatic conveyor belt 11 in terms of image writing positions.

A fixing portion 20 serves to fix toner images in a plurality of colors transferred to each transfer material R, and is composed of a rotary heating roller 21*a* and a pressurizing roller 21*b* brought into press contact therewith and adapted to apply heat and pressure to the transfer material R. That is, the transfer material R to which the toner images on the photosensitive drums 1 have been transferred is conveyed by the pressurizing roller 21*b* when passing the fixing portion 20, and, at the same time, receives heat and pressure from the heating roller 21*a*. As a result, toner images in a plurality of colors are fixed to the surface of the transfer material R.

In the image forming operation, the process cartridges 7*a*, 7*b*, 7*c*, and 7*d* are sequentially driven in accordance with the printing timing, and as they are thus driven, the photosensitive drums 1*a*, 1*b*, 1*c*, and 1*d* are rotated counterclockwise. Then, the scanner units 3 respectively corresponding to the process cartridges 7 are sequentially driven. By this driving, the charging rollers 2 impart uniform charge to the peripheral surfaces of the photosensitive drums 1, and the scanner units 3 perform exposure on the peripheral surfaces of the photosensitive drums 1 in accordance with image signals to form electrostatic latent images on the peripheral surfaces of the photosensitive drums 1. Developing sleeves 40 in the developing devices 4 cause toner to be transferred to the low potential portions of the electrostatic latent images to form toner images (i.e., perform development) on the peripheral surfaces of the photosensitive drums 1.

The registration rollers 19 start rotation to feed the transfer material R to the electrostatic conveyor belt 11 such that the leading end of the toner image on the peripheral surface of the most upstream photosensitive drum 1 is brought through rotation to a point where it is opposed to the electrostatic conveyor belt 11 simultaneously with the start of printing on the transfer material R at that point.

The transfer material R is held in press contact with the outer periphery of the electrostatic conveyor belt 11 by being nipped between an electrostatic attraction roller 22 and the electrostatic conveyor belt 11, and, by applying a voltage to the gap between the electrostatic conveyor belt 11 and the electrostatic attraction roller 22, a charge is induced in the transfer material R which is a dielectric, and the dielectric layer of the electrostatic conveyor belt 11, causing the transfer material to be electrostatically attracted to the outer periphery of the electrostatic conveyor belt 11. In this way, the transfer material R is attracted to the electrostatic conveyor belt 11 in a stable manner and transferred to the most downstream transfer portion.

While the transfer material R is thus conveyed, the toner images on the photosensitive drums 1 are sequentially transferred to the transfer material R by electric fields generated between the photosensitive drums 1 and the transfer rollers 12.

The transfer material R to which toner images in four colors have been transferred is separated from the electrostatic conveyor belt 11 due to the curvature of the belt driving roller 13, and is carried into the fixing portion 20. After the toner images have been thermally fixed to it by the fixing portion 20, the transfer material R is discharged to the exterior of the apparatus main body from a discharging portion 24 by discharging rollers 23, with the image side facing downwards.

[Construction of the Process Cartridge]

Figure 3A:
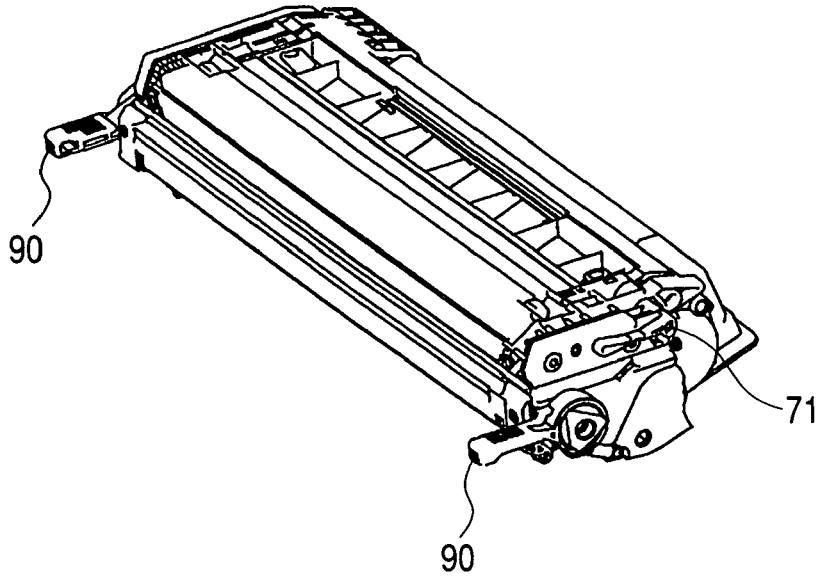
FIGS. 3A and 3B are perspective views of a process cartridge according to the present invention.
Figure 3B:
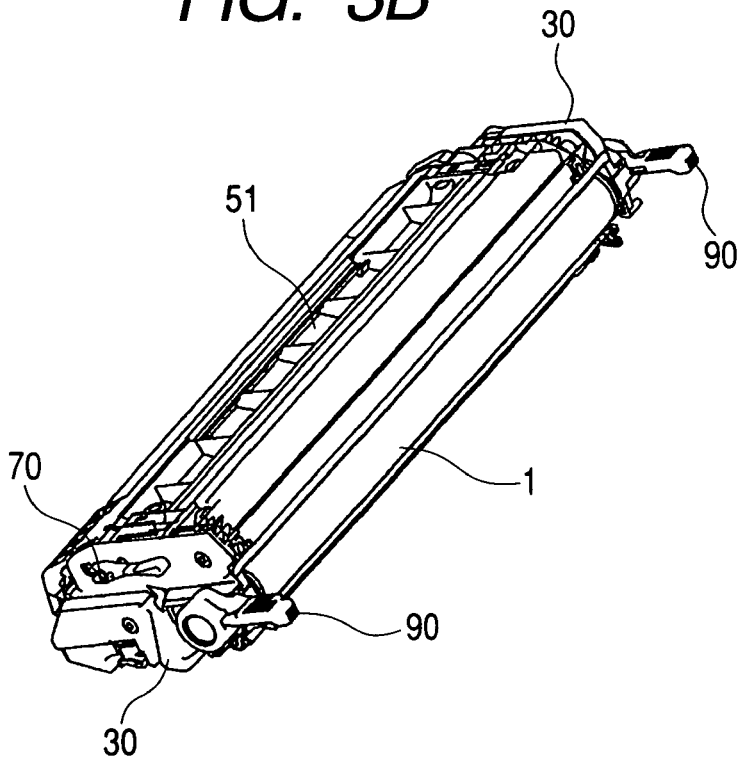

Next, a process cartridge according to the present invention will be described in more detail with reference to FIGS. 2, 3A, and 3B. FIGS. 2, 3A, and 3B are a main sectional view and perspective views of the process cartridge 7 containing toner.

The process cartridges 7*a*, 7*b*, 7*c*, and 7*d* respectively containing yellow, magenta, cyan, and black toners are of the same construction.

The process cartridge 7 is composed of the photosensitive drum unit 50 equipped with the electrophotographic photosensitive drum 1 serving as the image bearing member (hereinafter referred to as the photosensitive drum 1), the charging means, and the cleaning means, and the developing unit 4 having the developing means for developing electrostatic latent images on the photosensitive drum 1.

The photosensitive drum unit 50 has the photosensitive drum unit frame 51. At the ends of the photosensitive drum unit frame 51, there are provided bearing members 30 rotatably supporting the photosensitive drum. That is, the photosensitive drum unit frame 51 supports the photosensitive drum 1 through the intermediation of the bearing members. In the periphery of the photosensitive drum 1, there are arranged a primary charging means 2 for uniformly charging the photoconductive layer provided on the outer peripheral surface of the photosensitive drum 1, a cleaning blade 60 for removing developer remaining on the photosensitive drum 1 after transfer (residual toner), and a flexible sheet member 80. Further, the residual toner (waste toner) removed from the surface of the photosensitive drum 1 by the cleaning blade 60 is accommodated in a waste toner chamber 55 provided at the rear of the photosensitive drum unit frame. Further, the abutment condition for the flexible sheet member 80 is set such that while the transfer residual toner on the drum passes the portion of the flexible sheet member 80 in contact with the drum and reaches the position of the cleaning blade 60, the residual toner removed from the drum by the cleaning blade 60 does not leak to the exterior of the photosensitive drum unit frame 51.

The developing unit 4 is composed of the developing sleeve 40 rotating in the direction of the arrow Y while maintaining a minute gap between itself and the photosensitive drum 1, and developing frames 45*a* and 45*b* containing toner.

The developing frames 45*a* and 45*b* are connected to each other (by ultrasonic welding or the like) to form a developing unit frame 46.

The developing sleeve 40 is rotatably supported by the developing unit frame 46 through the intermediation of bearing members, and, in the periphery of the developing sleeve 40, there are arranged the toner supply roller 43 rotating in the direction of the arrow Z while in contact with the developing sleeve 40, and the developing blade 44. Further, inside the developing unit frame 46, there is provided a toner feeding mechanism 42 for agitating the contained toner and feeding it to the toner supply roller 43.

Then, by mating the connecting holes 47 and 48 provided at the ends of the developing unit frame 46 with the support holes provided at the ends of the photosensitive drum unit frame 51 of the photosensitive drum unit 50 and inserting the pins 49 from both ends of the photosensitive drum unit 50, a suspension structure is obtained in which the entire developing unit 4 is supported so as to be swingable with respect to the photosensitive drum unit 50.

Further, the developing unit 4 is constantly urged around the support holes by a pressurizing spring so as to hold the developing sleeve 40 in contact with the photosensitive drum 1. At the time of development, the toner contained in the toner container 41 is carried to the toner supply roller 43 by the toner feeding mechanism 42. The toner supply roller 43 rotating in the direction of the arrow Y is rubbed against the developing sleeve 40 rotating in the direction of the arrow Z to thereby supply the toner to the developing sleeve 40, causing it to be carried by the developing sleeve 40. As the developing sleeve 40 rotates, the toner carried by the developing sleeve 40 reaches the developing blade 44, which regulates the toner to form a predetermined thin toner layer, imparting a predetermined amount of charge thereto. As the developing sleeve 40 rotates, the toner turned into a thin layer on the developing sleeve 40 is carried to the developing portion where the photosensitive drum 1 and the developing sleeve 40 are in close proximity to each other, and, in the developing portion, a developing bias is applied to the developing sleeve 40 from a power source (not shown), whereby the toner adheres to the electrostatic latent image formed on the surface of the photosensitive drum 1, thereby developing the latent image. The toner remaining on the surface of the developing sleeve 40 without contributing to the development of the electrostatic latent image is returned to the developing device as the developing sleeve 40 rotates, and is separated from the developing sleeve 40 and recovered at the position where the developing sleeve 40 is rubbed against the toner supply roller 43. The recovered toner is mixed with the residual toner through agitation by the toner feeding mechanism 42.

[Attachment/Detachment of the Process Cartridge to/from the Image Forming Apparatus Main Body]

Figure 4:
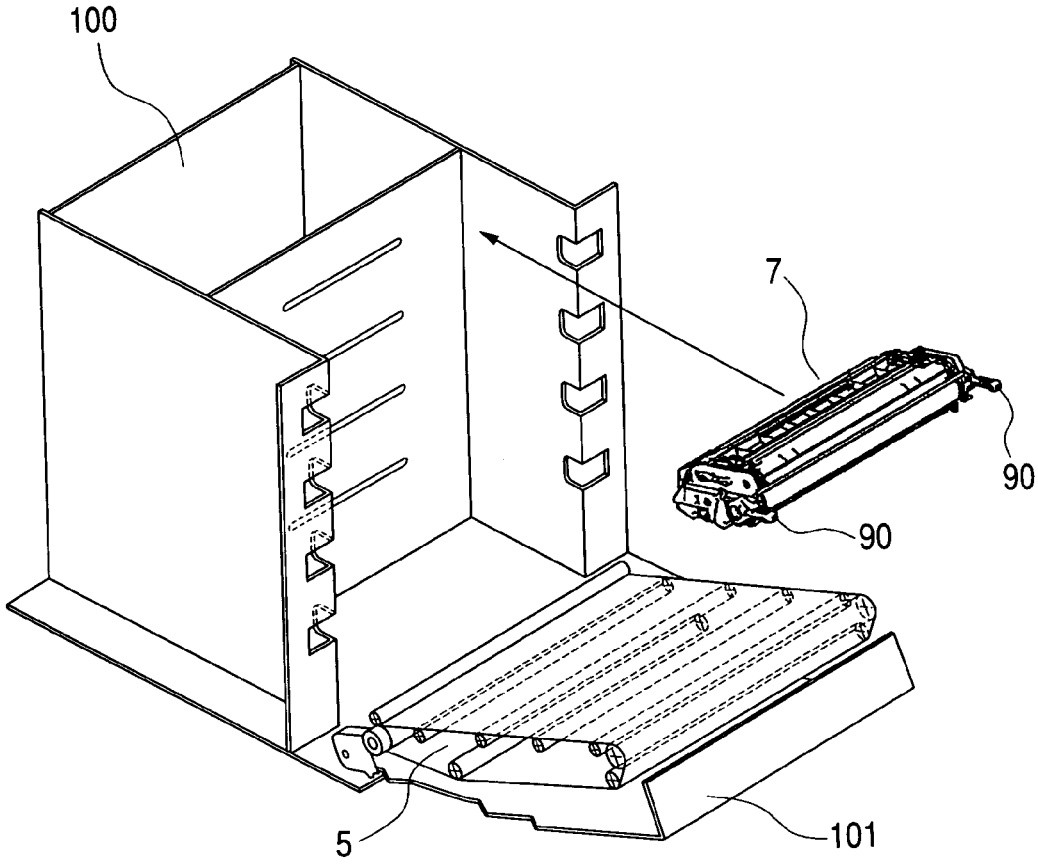
FIG. 4 is a schematic perspective view showing how a process cartridge is attached to an image forming apparatus main body according to the present invention.
Figure 5:
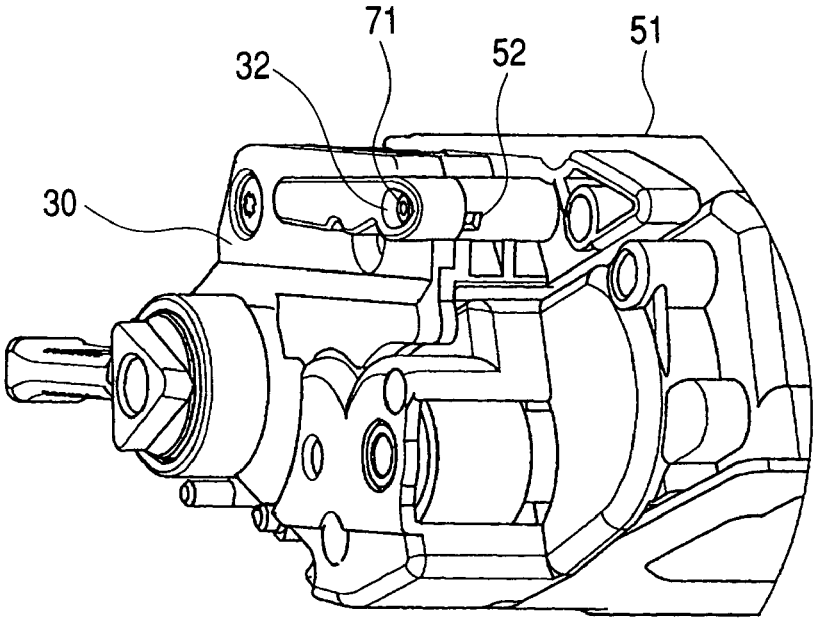
FIG. 5 is a perspective view of a terpene solvent injection inlet according to the present invention.

Next, the method of attaching/detaching the process cartridge 7 to/from the image forming apparatus main body 100 will be described with reference to FIG. 4. As shown in FIG. 4, the image forming apparatus main body 100 is equipped with a front cover 101, which is provided so as to be rotatable. Further, inside the front cover 101, an electrostatic transfer device 5 is rotatably provided. With the front cover 101 and the electrostatic transfer device 5 being open, the process cartridge 7 is detachably mountable to the image forming apparatus main body 100. In the vicinity of the photosensitive drum support portions at the ends of the process cartridge 7, there are provided grip members 90, which protrude on the front cover side of the main body when the cartridge is attached/detached.

A guide rail portion (not shown) provided in the image forming apparatus main body 100 and an insertion guide portion (not shown) provided on the process cartridge 7 are engaged with each other, whereby the process cartridge 7 is detachably mountable to the image forming apparatus main body 100.

Embodiment 1

Next, Embodiment 1 of the present invention will be described with reference to FIGS. 5 through 10.

First, connection between a connecting pin 71, serving as a connecting member, and the photosensitive drum unit frame 51 will be described.

The connection between the photosensitive drum unit frame 51 and the connecting pin 71 is effected as follows.

The connecting pin 71 is composed of small diameter portions 71*b* at the ends and a large diameter portion 71*c* at the center.

The connection between the small diameter portions 71*b* of the connecting pin 71 and the photosensitive drum unit frame 51 is effected by press fitting.

The connection between the large diameter portion 71*c* of the connecting pin 71 and the photosensitive drum unit frame 51 is effected by the following connections: connection through adhesion, by an adhesive consisting of a terpene solvent, of a part or all of a fitting portion S where there is a minute gap between the large diameter portion 71*c* of the connecting pin 71 and the photosensitive drum unit frame 51, and connection through press fitting of the large diameter portion 71*c* and the small diameter portions 71*b* of the connecting pin 71 into the photosensitive drum unit frame 51.

The method of injecting the adhesive for effecting connection between the large diameter portion 71*c* of the connecting pin 71 and the photosensitive drum unit frame 51 will be described.

In the photosensitive drum unit frame 51, a cutout 52 is formed in the portion into which the connecting pin 71 is fitted, and the cutout 52 serves as the injection inlet for the terpene solvent serving as the adhesive. The terpene solvent injected through the injection inlet flows into a flow passage (first flow passage) for the adhesive for connecting the photosensitive drum unit frame 51 and the connecting pin 71 to each other. More specifically, the supplied solvent fills the fitting portion S, using, as the first flow passage, a gap which communicates with the injection inlet and which is between the inner peripheral portion 53*a* of the photosensitive drum unit frame and the outer peripheral portion 71*a* of the connecting pin, thus effecting integral connection.

The portion where the connection between the large diameter portion 71*c* of the connecting pin 71 and the photosensitive drum unit frame 51 is effected by press fitting extends over the range indicated by reference symbol E, which is 1 to 3 mm from a wall end surface 51*c* of a recess 51*b* of the photosensitive drum unit frame 51. Thus, due to the portion E, where the press fitting is effected, the terpene solvent is prevented from flowing to the developing unit frame side.

It is desirable for the supply of terpene solvent to the fitting portion to be effected by a capillary phenomenon. In view of this, a slight contact or a minute gap is desired in the fitting portion. In this embodiment, the fitting engagement between the inner peripheral portion 53*a* of the photosensitive drum unit frame and the outer peripheral portion 71*a* of the connecting pin is H9/g9.

By thus diminishing the press fitting region between the photosensitive drum unit frame and the connecting pin, the requisite insertion force for the connecting pin 71 is reduced, thereby achieving an improvement in terms of productivity. Further, since as little stress as possible is imparted to the photosensitive drum unit frame 51, the distortion of the photosensitive drum unit frame is mitigated, and it is possible to achieve an improvement in terms of the arrangement accuracy of the photosensitive drum and the cleaning blade.

Due to its symmetrical configuration, the connecting pin 71 of this embodiment allows assembly with no directional limitation.

The suspension portion 49 of the developer container is swingably supported, with a minute gap between itself and the large diameter portion 71*c* of the connecting pin 71.

Next, the connection between the photosensitive drum unit frame 51 and the drum bearing members 30 will be described.

The connection between the photosensitive drum unit frame 51 and each drum bearing member 30 is effected by a terpene solvent injected through an injection inlet 52.

Here, the adhesive flow passage (second flow passage) for effecting the connection between the photosensitive drum unit frame 51 and the drum bearing member 30 is connected to the first adhesive flow passage for effecting the connection between the photosensitive drum unit frame 51 and the connecting pin 71. Thus, by injecting the terpene solvent into the terpene solvent injection inlet 52, it is possible to effect the connection between the photosensitive drum unit frame 51 and the drum bearing member 30 and the connection between the photosensitive drum unit frame 51 and the connecting pin 71 by a single process, thereby achieving an improvement in terms of productivity. This will be described more specifically. The joint surface T of the photosensitive drum unit frame 51 (the shaded area in FIG. 6) has minute protrusions and recesses (not shown) and a recess (slit) 54 constituting the second flow passage extending from the hole 53 in fit-engagement with the connecting pin 71. It is desirable for the supply of the terpene solvent to the joint surface T to be effected by a capillary phenomenon. Thus, it is desirable for the recess 54, communicating with the terpene solvent injection inlet 52 and constituting the flow passage to the joint surface T, to have a width of 0.1 to 2 mm and a depth of 0.1 to 2 mm, and it is desirable for the flow passage formed by the recess 54 to have a sectional area of 4 mm or less. In a flow passage having a sectional area larger than 4 $mm^2$, a capillary phenomenon does not occur easily, and the supply of terpene solvent to the joint surface T has a tendency to become difficult. In this embodiment, the recess has a width of 0.5 mm and a depth of 0.5 mm, and is situated within the range of the minute protrusions and recesses.

Figure 6:
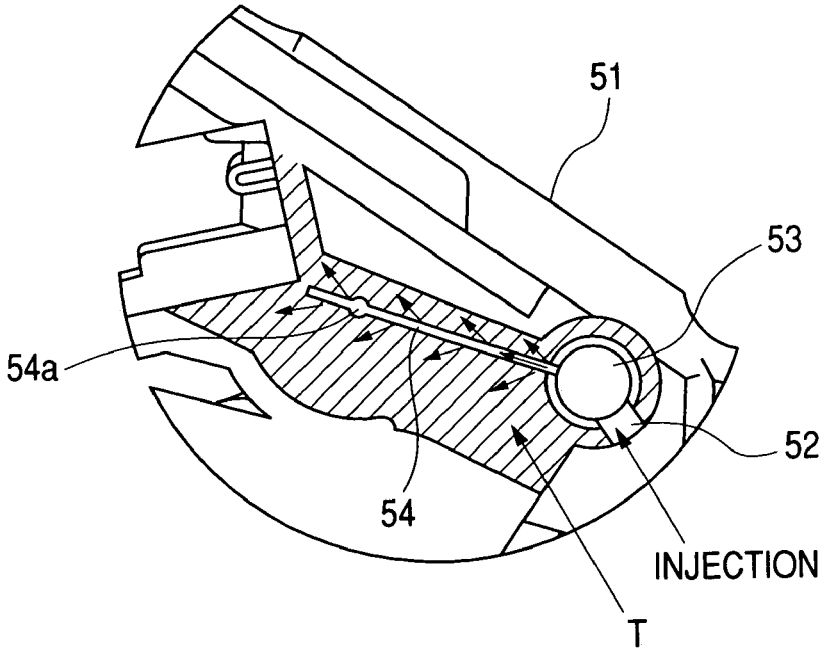
FIG. 6 is a detailed view of a joint surface of a photosensitive drum unit frame according to the present invention.
Figure 7:
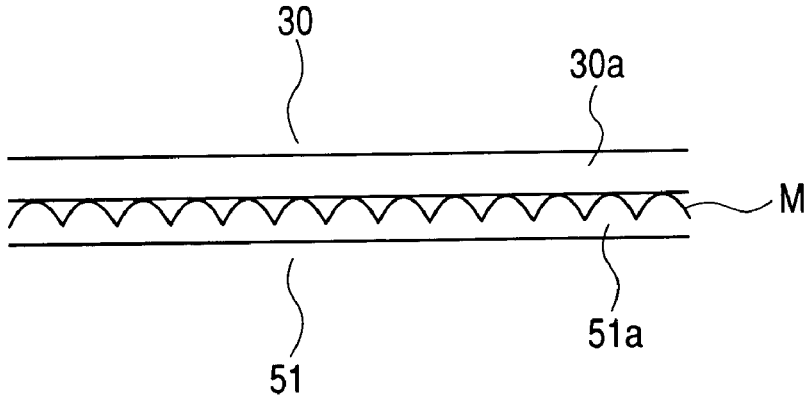
FIG. 7 is a schematic sectional view of a joint surface between a photosensitive drum unit frame and a drum bearing member.

The terpene solvent having passed through the fit-engagement portion of the first flow passage and supplied to the portion in the vicinity of the joint surface T, is spread from the flow passage over the entire joint surface T due to the capillary phenomenon of the recess of the second flow passage and the minute protrusions and recesses formed around the same, with the result that the surfaces of the photosensitive drum unit frame 51 and the drum bearing member 30 are integrally joined together (see the arrows in FIG. 6).

When the terpene solvent having passed through the first flow passage is to be spread over the entire joint surface by the second flow passage, the supply thereof to the joint surface by utilizing a capillary phenomenon is rather difficult if the gaps between the components to be joined together are large. On the other hand, when the surfaces to be joined together are being firmly pressed against each other and the contact strength is high, a capillary phenomenon does not occur easily, either, making the supply of terpene solvent rather difficult. Thus, it is desirable that the portions to be joined together be in close proximity to or in slight contact with each other; in this regard, it is also desirable, as indicated by reference symbol M in FIG. 7, to provide minute protrusions and recesses in at least one of the joint surfaces so as to define a space allowing the terpene solvent to be spread over the joint surface by a capillary phenomenon. Such protrusions and recesses consist, for example, of wrinkles whose average depth (Rz) preferably ranges from 20 to 40 μm. When the depth exceeds 40 μm, the connection of the trough portions of the wrinkles with the mating component is rather insufficient, with the result that the joint strength tends to be reduced as a whole.

In the joint portion of this embodiment, the wrinkles are formed in the joint surface 51*a* of the photosensitive drum unit frame 51 and the mating joint surface 30*a* of the drum bearing member 30 is flat.

Figure 8:
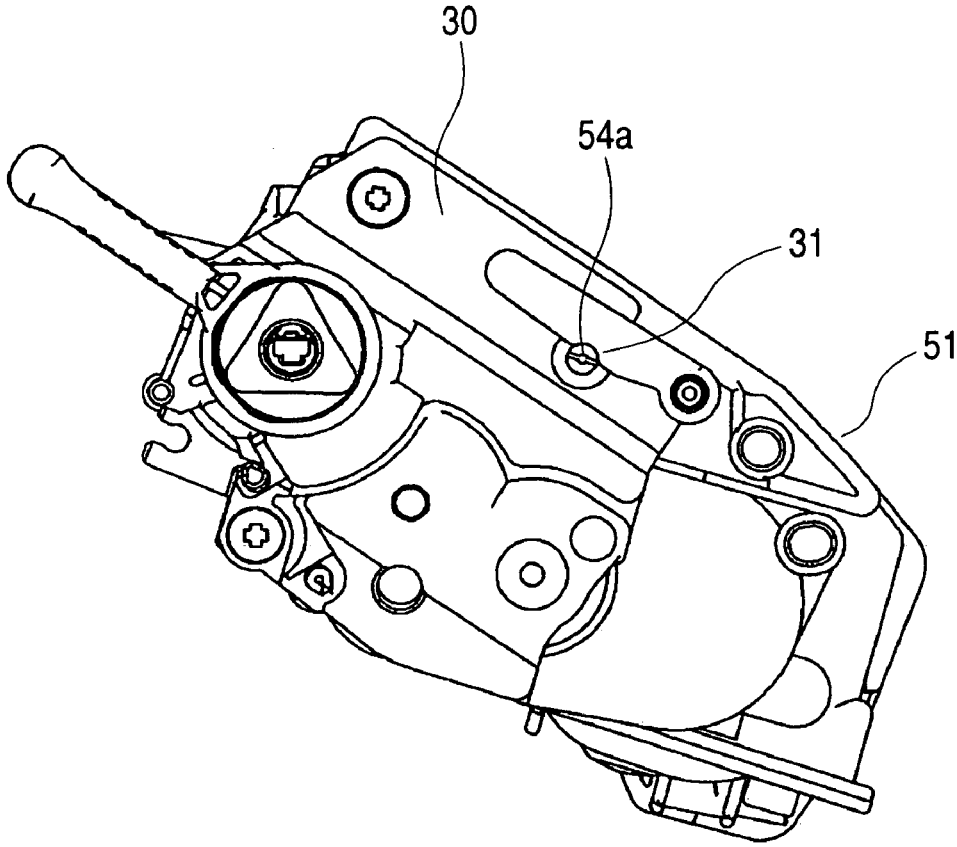
FIG. 8 is a side view of a process cartridge according to the present invention.
Figure 9:
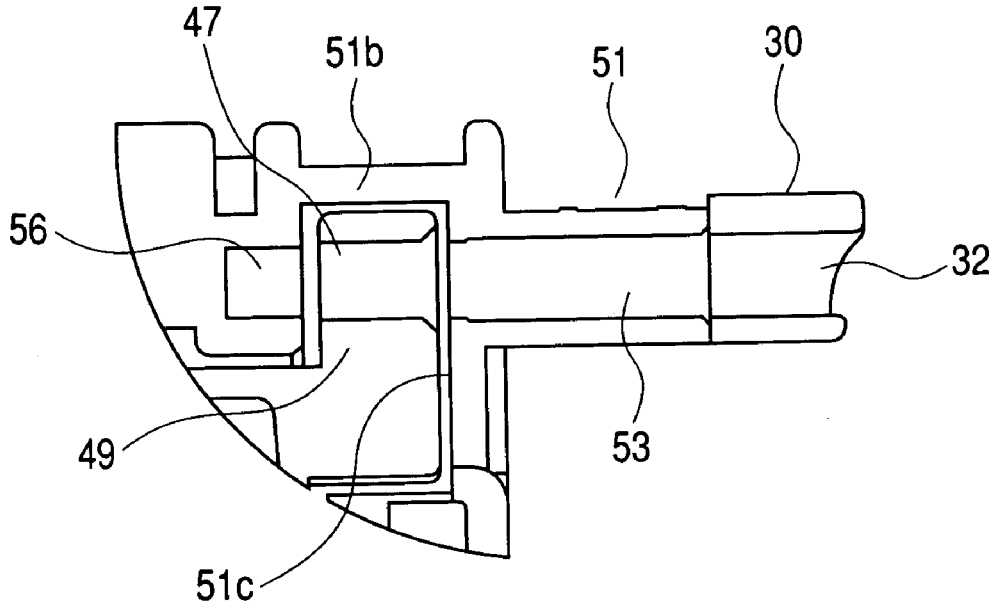
FIG. 9 is a sectional view showing a state prior to insertion of a connecting pin according to the present invention.
Figure 10:
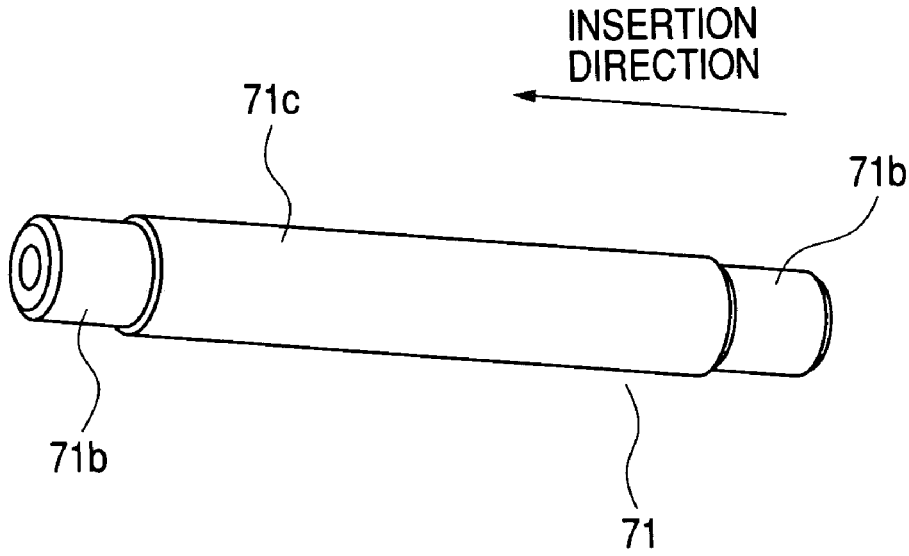
FIG. 10 is a perspective view of a connecting pin according to the present invention.
Figure 11:
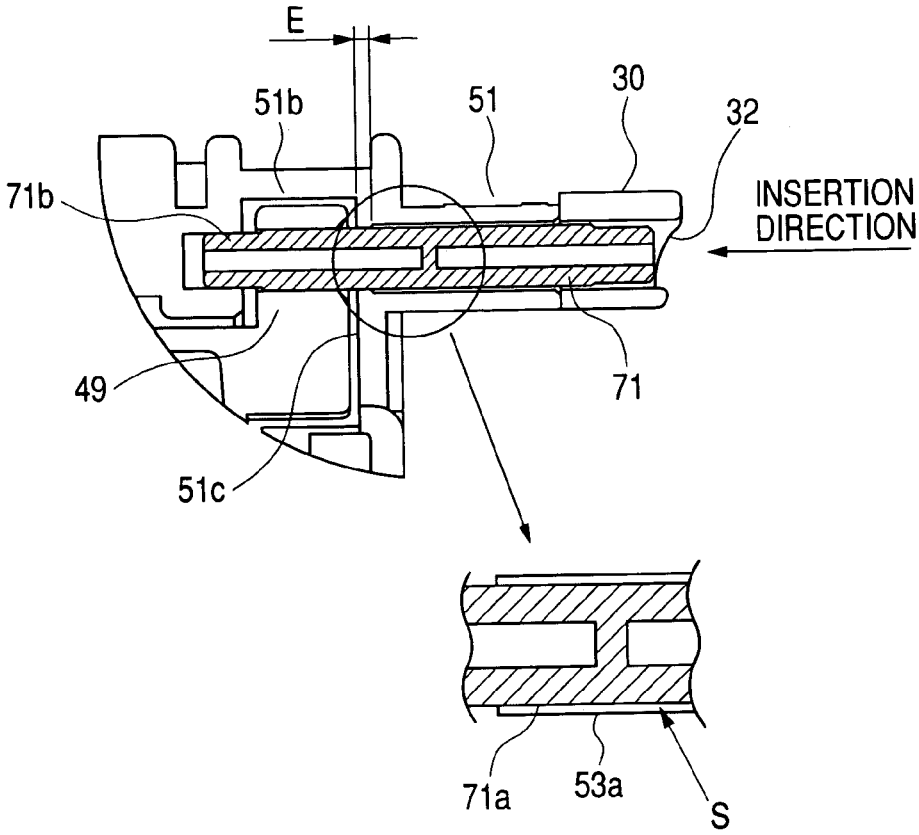
FIG. 11 is a sectional view of a connecting pin inserting portion according to the present invention.

As shown in FIG. 8, a hole 31 is formed in a part of the drum bearing member 30 so as to be opposed to a position where the recess 54 is partly visible. Here, the region of the recess 54 that can be checked through the hole 31 is indicated by reference symbol 54*a*. As described above, the injected terpene solvent flows from the injection inlet through the recess 54 constituting the second flow passage to pervade the joint surface T, so that, during that process, it is possible to check from outside how the solvent passes through the recess 54*a*. Further, if the passing of the terpene solvent is not ascertained in real time, it can be ascertained after a fixed period of time has elapsed since the surface gloss of the recess 54*a* changes after the passage of the terpene solvent.

Specific examples of the inspection means include visual inspection by the inspector, various apparatuses, such as means for measuring displacement of the recess 54*a* by a laser displacement meter, and means for performing photographing by a photographing device using a CCD camera (image processing device) and analyzing and judging the obtained image by an analysis device. As compared with the conventional destructive inspection through sampling, all of the above-mentioned means make it possible to perform total inspection very easily; further, there are no cartridges to be disposed of, thereby achieving a substantial improvement in terms of production efficiency.

In this embodiment, the injection of the terpene solvent is performed with the terpene solvent injection inlet placed at the top position, facilitating the pervasion of the solvent by the gravitational force. However, there are no particular limitations regarding the injection attitude as long as the solvent can pervade the entire joint area. In this embodiment, the injection amount is 10 to 50 μl.

In the present invention, there are no particular limitations regarding the frame and components to be joined together as long as they consist of a styrene-based resin composite that can be dissolved in a terpene solvent. Examples of a styrene-based resin composite that can be suitably used as the cartridge material include high-impact polystyrene (HIPS), which is a rubber-modified styrene-based material. In order to achieve an improvement in impact resistance, this material is obtained by mixing a rubber-like polymer or a rubber-like copolymer with polystyrene (PS), which is inexpensive and of satisfactory fluidity.

Further, examples of the terpene-based solvent used for connection in the present invention include d-limonene, 1-limonene, dl-limonene, d-α-pinene, d-β-pinene, α-terpinene, β-terpinene, γ-terpinene, terpinolene, 2-carene, d-3-carene, 1-3-carene, and phellandrene. Of those, d-limonene, 1-limonene, and dl-limonene are preferably used. Of those, d-limonene which provides the highest solubility of the styrene-based resin is particularly preferably used.

Embodiment 2

Figure 12:
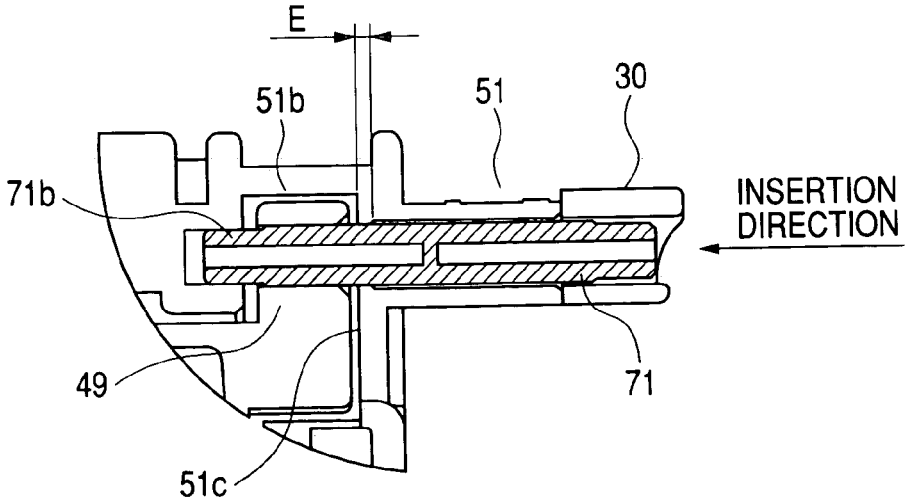
FIG. 12 is a sectional view of a connecting pin inserting portion according to the present invention (Embodiment 2)

Next, Embodiment 2 of the present invention will be described with reference to FIG. 12.

In Embodiment 1, the inner peripheral portion 32 of each drum bearing member 30 has, between itself and the outer peripheral portion 71*a* of the connecting pin 71, a gap small enough not to allow intrusion of terpene solvent by a capillary phenomenon. In Embodiment 2, in contrast, there is secured, between the inner peripheral portion 32 of each drum bearing member 30 and the outer peripheral portion 71*a* of the connecting pin 71, a gap large enough to allow intrusion of terpene solvent by a capillary phenomenon. Due to this arrangement, the three components (the connecting pin 71, the photosensitive drum unit frame 51, and the drum bearing member 30) can be joined together by a single injection of terpene solvent.

Embodiment 3

Figure 13:
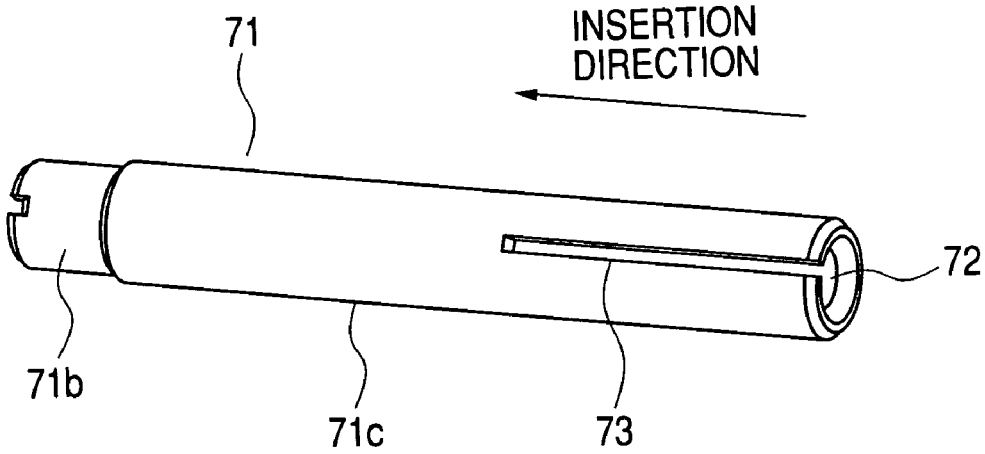
FIG. 13 is a perspective view of a connecting pin according to the present invention (Embodiment 3)
Figure 14:
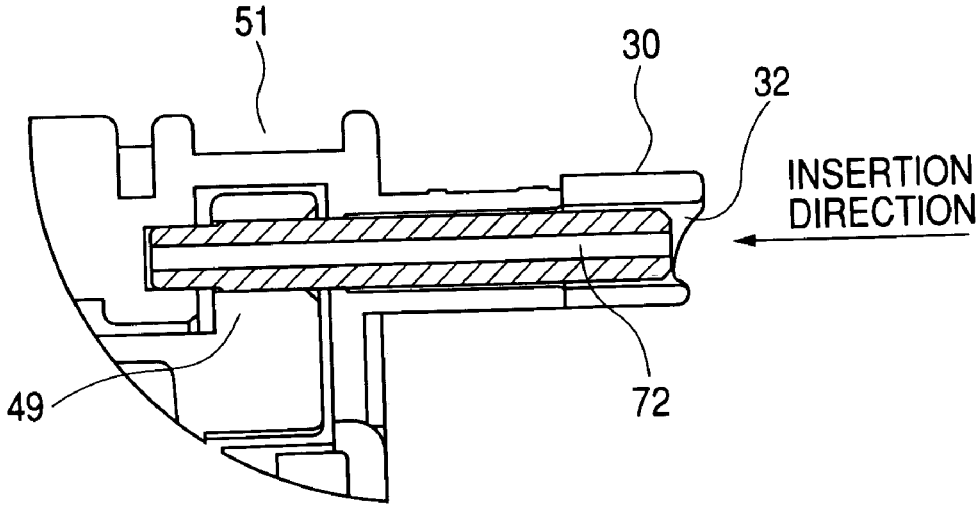
FIG. 14 is a sectional view of a connecting pin inserting portion according to the present invention (Embodiment 3)

Next, Embodiment 3 of the present invention will be described with reference to FIGS. 13 and 14.

In the connecting pin 71 described with reference to Embodiment 1, a communication hole 72 is formed so as to extend in the axial direction, and, further, a slit 73 is formed in the portion of the large diameter portion of the connecting pin corresponding to the cutout (the terpene solvent injection inlet) 52 formed in the photosensitive drum unit frame. Further, the fit-engagement of the small diameter portion 71*b* of the connecting pin 71 and the photosensitive drum unit frame 51 is effected in H9/g9 with a minute gap therebetween. Due to this construction, a flow passage for the terpene solvent is also formed in the communication hole 72, making it possible to effect connection by adhesive of the small diameter portion 71*b* and the photosensitive drum unit frame 51 by the terpene solvent supplied from the injection inlet 52. Further, by effecting press-fitting between the small diameter portion 71*b* and part of the photosensitive drum unit frame 51, it is possible to realize a construction in which no terpene solvent flows to the developer container side.

Embodiment 4

Figure 15:
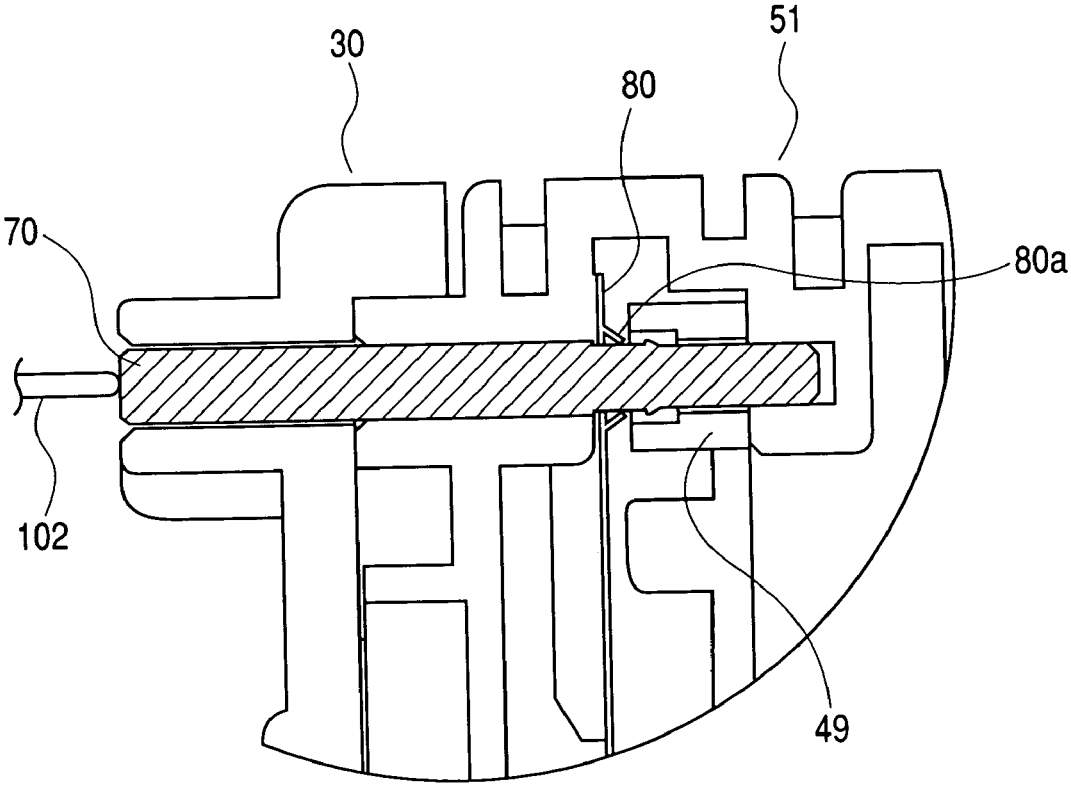
FIG. 15 is a sectional view of a connecting pin inserting portion according to the present invention (Embodiment 4).

Next, Embodiment 4 of the present invention will be described with reference to FIG. 15.

A connecting pin 70 formed of a conductive styrene-based resin composite can also serve as a contact. More specifically, the connecting pin 70 comes into contact with a main body contact 102 that is in electrical contact with a high-voltage unit in the image forming apparatus main body 100, and a high-voltage current is applied to an electrode plate 80 of the process cartridge 7 through the connecting pin 70 to supply electricity to the charging device 2. The electrode plate 80 is equipped with a cut-and-raised portion 80*a*, which is in contact with the connecting pin 70. The electrode plate 80 effects connection between the connecting pin 70 and the charging device 2.

While the invention has been described with reference to the structures disclosed herein, it is not confined to the details set forth and this application is intended to cover such modifications or changes as may come within the purpose of the improvements or the scope of the following claims.

What is claimed is:

1. A process cartridge detachably mountable to an image forming apparatus main body, said process cartridge comprising:

an electrophotographic photosensitive drum;

a bearing member rotatably supporting the electrophotographic photosensitive drum;

a photosensitive drum unit frame supporting the bearing member;

a developing unit frame supporting a developer carrying member for developing a latent image formed on the electrophotographic photosensitive drum; and a connecting member swingably supporting the developing unit frame and the photosensitive drum unit frame, wherein a first flow passage for an adhesive for bonding the photosensitive drum unit frame and the connecting member to each other and a second flow passage for an adhesive for bonding the photosensitive drum unit frame and the bearing member to each other are communicated with each other, and wherein, by injecting an adhesive into the first flow passage and the second flow passage communicated with each other, the photosensitive drum unit frame and the connecting member are connected to each other with the adhesive and the photosensitive drum unit frame and the bearing member are connected to each other with the adhesive.

2. A process cartridge according to claim 1, wherein the photosensitive drum unit frame has a cutout for allowing injection of the adhesive into the flow passages communicated with each other.

3. A process cartridge according to claim 1, wherein the connection between the photosensitive drum unit frame and the connecting member is effected by performing press-fitting between the photosensitive drum unit frame and the connecting member, and by effecting adhesion, by the adhesive, of a part or all of a fit-engagement portion where a gap is defined between the photosensitive drum unit frame and the connecting member, in the fit-engagement portion.

4. A process cartridge according to claim 3, wherein the adhesive is prevented from flowing to the developing unit frame side by a press-fit portion where press-fitting is effected between the photosensitive drum unit frame and the connecting member.

5. A process cartridge according to claim 1, wherein the connection between the photosensitive drum unit frame and the bearing member is effected by bonding contacting portions of a surface of the photosensitive drum unit frame and a surface of the bearing member to each other.

6. A process cartridge according to claim 1, wherein the photosensitive drum unit frame, the bearing member, and the connecting member are formed of a resin.

7. A process cartridge according to claim 1, wherein the photosensitive drum unit frame, the bearing member, and the connecting member are formed of a polystyrene-based resin, and wherein the adhesive includes a terpene solvent.

8. A process cartridge according to claim 1, wherein the photosensitive drum unit frame, the bearing member, and the connecting member are formed of a polystyrene-based resin, and wherein the adhesive includes d-limonene.

9. A process cartridge according to claim 1, wherein the photosensitive drum unit frame has a cleaning blade abutting a surface of the electrophotographic photosensitive drum.

10. A process cartridge according to claim 1, wherein, by injecting an adhesive into the flow passages communicated with each other, the bearing member and the connecting member are connected by the adhesive.

11. A process cartridge according to claim 1, wherein the connecting member has a through-hole in an axial direction, and wherein the adhesive can pass through the through-hole.

12. A process cartridge according to claim 1, wherein the connecting member is conductive, and is used as an electric contact.

13. An electrophotographic image forming apparatus to which a process cartridge is detachably mountable for forming an image on a recording medium, said electrophotographic image forming apparatus comprising:

a process cartridge comprising:

an electrophotographic photosensitive drum;

a bearing member rotatably supporting the electrophotographic photosensitive drum;

a photosensitive drum unit frame supporting the bearing member;

a developing unit frame supporting a developer carrying member for developing a latent image formed on the electrophotographic photosensitive drum; and a connecting member swingably supporting the developing unit frame and the photosensitive drum unit frame, wherein a first flow passage for an adhesive for bonding the photosensitive drum unit frame and the connecting member to each other and a second flow passage for an adhesive for bonding the photosensitive drum unit frame and the bearing member to each other are communicated with each other, and wherein, by injecting an adhesive into the first flow passage and the second flow passage communicated with each other, the photosensitive drum unit frame and the connecting member are connected to each other with the adhesive and the photosensitive drum unit frame and the bearing member are connected to each other with the adhesive.

14. A process cartridge detachably mountable to an image forming apparatus main body, said process cartridge comprising:

a photosensitive drum unit frame supporting an electrophotographic photosensitive drum;

a developing unit frame supporting a developer carrying member for developing a latent image formed on the electrophotographic photosensitive drum; and a connecting member swingably supporting the developing unit frame and the photosensitive drum unit frame, wherein connection is effected between the photosensitive drum unit frame and the connecting member by performing press-fitting between the photosensitive drum unit frame and the connecting member, and by effecting adhesion, by an adhesive, of a part or all of a fit-engagement portion where a gap is defined between the photosensitive drum unit frame and the connecting member, in the fit-engagement portion.

15. A process cartridge according to claim 14, wherein the adhesive is prevented from flowing to the developing unit frame side by a press-fit portion where press-fitting is effected between the photosensitive drum unit frame and the connecting member.

16. A process cartridge according to claim 14, wherein the photosensitive drum unit frame supports the electrophotographic photosensitive drum through a bearing member rotatably supporting the electrophotographic photosensitive drum.

* * * * *